United States Patent [19]

Poo

[11] Patent Number: 4,941,658

[45] Date of Patent: Jul. 17, 1990

[54] FABRICATED AMUSEMENT PLATFORM

[75] Inventor: Kent Poo, Taipei, Taiwan

[73] Assignee: Omni World, Inc., Taipei, Taiwan

[21] Appl. No.: 362,140

[22] Filed: Jun. 6, 1989

[51] Int. Cl.[5] ..... A63B 17/00

[52] U.S. Cl. ..... 272/56.5 R; 272/113

[58] Field of Search ..... 272/56.5 R, 112, 113

[56] References Cited

U.S. PATENT DOCUMENTS

| | | | |
|---|---|---|---|
| 3,969,871 | 7/1976 | Ewers | 272/56.5 R |
| 4,369,965 | 1/1983 | Ahrens | 272/56.5 R |
| 4,484,738 | 11/1984 | Ahrens et al. | 272/56.5 R |
| 4,497,279 | 2/1985 | Bell | 272/113 X |
| 4,630,819 | 12/1986 | Levin | 272/113 |
| 4,796,884 | 1/1989 | Ely et al. | 272/113 |

FOREIGN PATENT DOCUMENTS

| | | | |
|---|---|---|---|
| 1126303 | 6/1982 | Canada | 272/56.5 R |

*Primary Examiner*—Richard E. Chilcot, Jr.
*Attorney, Agent, or Firm*—Finnegan, Henderson, Farabow, Garrett & Dunner

[57] ABSTRACT

A fabricated platform includes a plurality of skeleton members having at least one pair of columns adapted to be disposed vertically on a mounting surface, a plurality of block members having a pair of throughholes adapted to be simultaneously passed through by a pair of columns of one of the skeleton members; and a plurality of plate members each having a plurality of pairs of holes formed therethrough. The two holes in each pair formed in the plate members are spaced apart from each other at a distance equal to the distance between the two columns of one of the skeleton members. The fabricated platform is assembled by passing the columns of the skeketon members through the throughholes of the block members and the holes of the plate members so as to vertically stack the block members which may be interposed between the plate members. The block members may also stably support the plate members which are suspended among the columns of the skeleton members. The fabricated platform can be dismantled by pulling the columns of the skeleton members out from the throughholes of the block members and the holes of the plate members. In this way, the fabricated platform can be easily reassembled in another pattern or at another desired location.

3 Claims, 3 Drawing Sheets

FABRICATED AMUSEMENT PLATFORM

BACKGROUND OF THE INVENTION

This invention relates to an amusement platform, more particularly to a fabricated platform which can be easily disassembled and transported to another place.

A playground for children usually has an amusement platform mounted with ladders, slides, nets or hanging ropes so that children can develop their physical skills while at play. A conventional amusement platform is usually made of wood, steel, and concrete. However, conventional amusement platforms suffer from the following disadvantages:

(1) An amusement platform which consists of wooden parts or steel parts is usually assembled by means of screws. The processes of assembling and disassembling said parts of the platform are complicated and untidy. Hence, it is difficult to reassemble the platform into another pattern or at another location. In addition, children are liable to be accidentally injured by the screws which serve to hold the parts of such an amusement platform together.

(2) A concrete platform cannot be moved or reconstructed. In addition, the rough surface of the concrete may injure the children while they are playing thereon.

SUMMARY OF THE INVENTION

It is therefore an object of this invention to provide a fabricated amusement platform which can be easily assembled and dismantled so as to be reassembled into another pattern or at another location.

Another object of this invention is to provide a fabricated amusement platform that will not injure the children playing thereon.

Accordingly, a fabricated amusement platform of this invention includes a plurality of skeleton members having at least one pair of columns adapted to be disposed vertically in relation to a mounting surface; a plurality of block members having a pair of throughholes adapted to be simultaneously passed by a pair of columns of one of the skeleton members; and a plurality of plate members each having a plurality of holes formed therethrough. Each of the holes of the plate members are spaced apart from each other at a distance equaling the distance between the two columns of one of the skeleton members. The fabricated amusement platform is assembled by passing the columns of the skeleton members through the throughholes of the block members and the holes of the the plate members so as to vertically pile up the block members which may be interposed between the plate members and stably support the plate members which are suspended among the columns of certain of the skeleton members. In addition, the fabricated amusement platform can be disassembled by pulling the columns of the skeleton members out from the throughholes in the block members and the holes in the plate members. Therefore, the fabricated amusement platform can be easily assembled into another pattern or at another desired location. In addition, the fabricated amusement platform is preferably made of a plastic material so that children playing thereon will not be injured while playing thereon.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
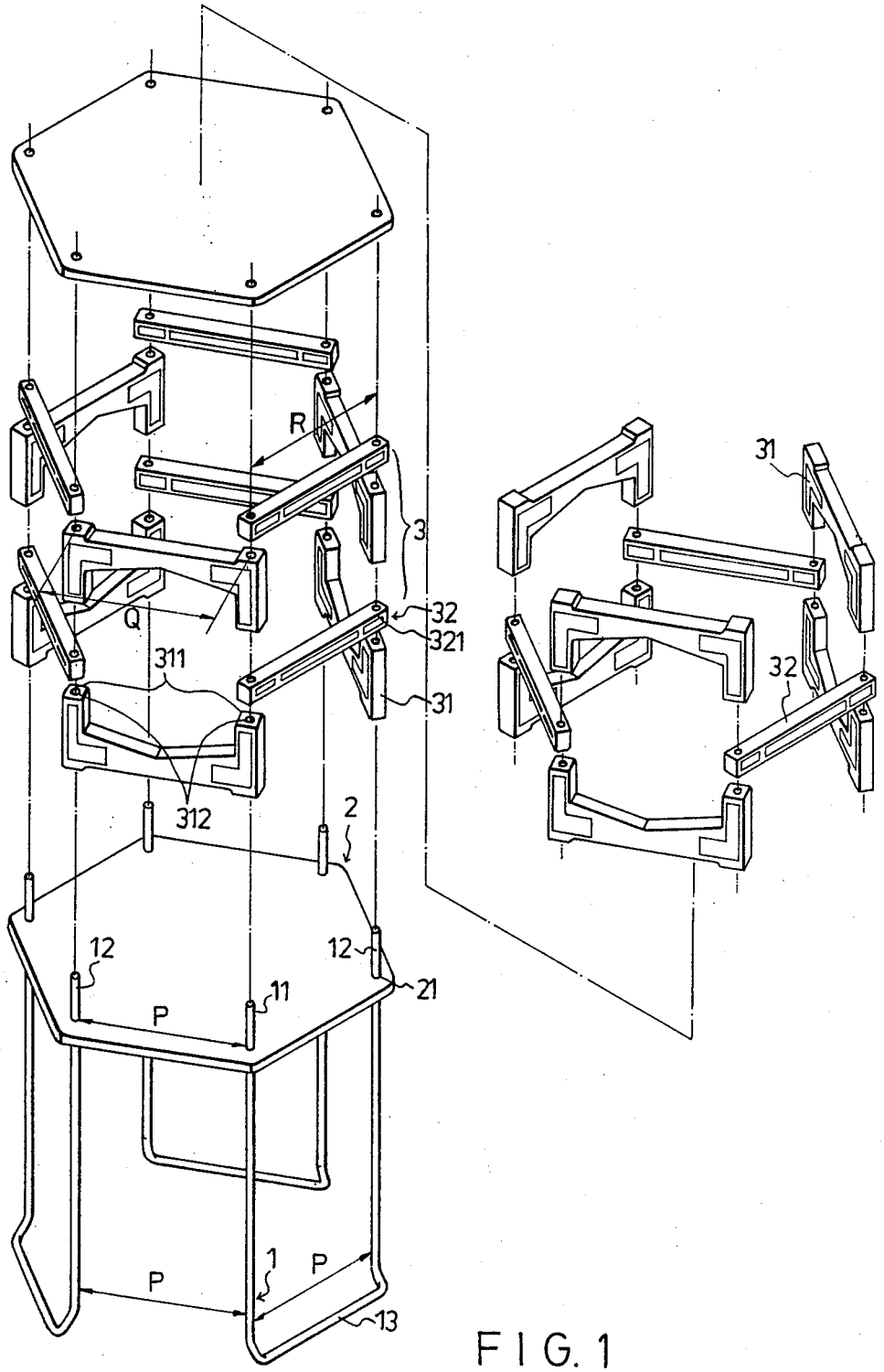
FIG. 1 is a perspective exploded view of a first preferred embodiment of a fabricated amusement platform of this invention.

Referring to FIG. 1, a fabricated amusement platform of this invention includes three U-shaped skeleton members 1, two hexagonal flat plates 2, and a plurality of block members 3. Each of the U-shaped skeleton members 1 has two columns 11, 12, which are spaced apart from each other at a certain distance (P), and a connecting portion interconnecting between the two columns 11, 12. Each angle of the hexagonal plate 2 has a hole 21 formed therethrough. The holes 21 of the hexagonal plate 2 are spaced apart from each other at a certain distance (P) which is equal to that between the columns 11, 12 of the skeleton member 1 so that the columns 11, 12 of a skeleton member 1 can pass through pairs of adjacent holes 21 in the plate 2.

The block members 3, which are made of a plastic material, such as PVC (polyvinyl chloride), consist of a first set of U-shaped block members 31 and a second set of bar-like block members 32. Each of the first block members 31 has two legs 311 each of which has a throughhole 312 formed therein. The distance (Q) between the two throughholes 312 equals the distance (P) between two adjacent holes 21 of the plate 2. Each of the second block members 32 has two throughholes 321 which are spaced apart from each other at a distance (R). The distance (R) is equal to the distance (Q) and the distance (P) so that the columns 11, 12 of the skeleton member can both pass through the holes 21 of the plate 2 and pass through the throughholes 311, 321 of the block member 3, thereby interconnecting the abovementioned members.

Figure 2:
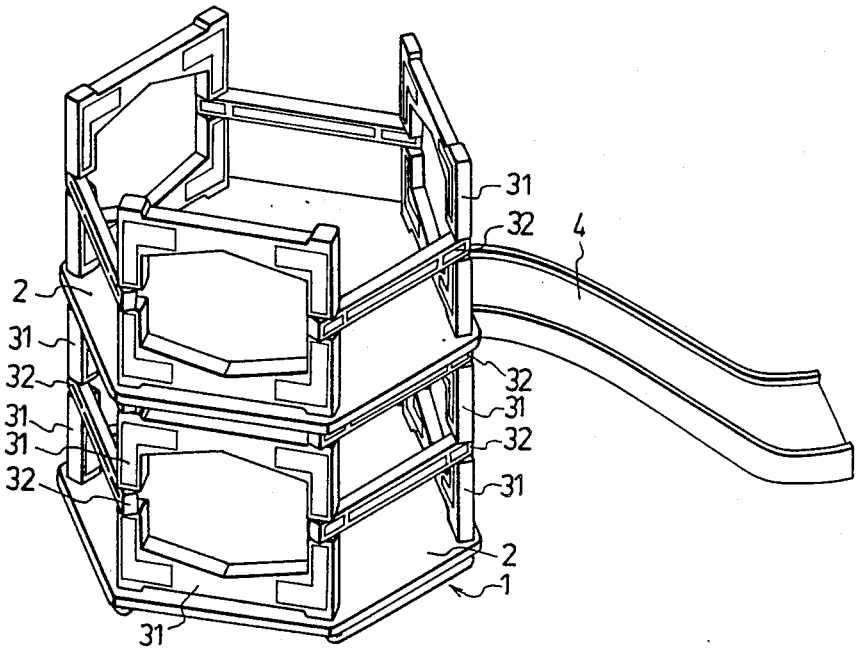
FIG. 2 is a perspective view of a second preferred embodiment of a fabricated amusement platform of this invention.

Referring to FIGS. 1 and 2, three skeleton members 1 are vertically disposed on a mounting surface (not shown). Each of the two columns 11, 12 of each of the skeleton members 1 is passed through one of the two adjacent holes 21 of the flat plate 2. The columns 11, 12 of the skeleton members 1 are respectively passed through three first block members 31. The column 11 of one skeleton member 1 and the column 12 of the other skeleton member 1 are respectively passed through the two throughholes 311 of each of the first block members 31. Three second block members 32 are then disposed at a position above the first block members 31. The columns 11, 12 of one of the skeleton members 1 are passed through the throughholes 321 of each of the second blocks 32. Three first block member 31 and three second block members 32 are piled onto the abovementioned three second block members 32 with their throughholes 311, 321 being passed through by the columns 11, 12 of the skeleton members 1 in a similar manner. An upper flat plate 2 is then disposed at a position above the block members 3. As a result, six first block members 31 and six second block members 32 are interposed between the two flat plates 2. Another three first block members 31 and three second block members 32 are stacked onto the upper flat plate 2 in a similar manner with their throughholes 311, 321 being passed through by the columns 11, 12 of the skeleton members 1. Finally, three first block members 31 are mounted to the upper free ends of the columns 11, 12. Each of said first block members 31 has two holes which are spaced apart from each other at a distance (Q) into which are respectively inserted by the column 11 of one skeleton member 1 and the column 12 of the other skeleton member I so that the free ends of said columns 11, 12 will not protrude out from the uppermost block members 3. A slide 4 may be connected to the upper flat plate 2 for added amusement purposes, as best illustrated in FIG. 2.

Figure 3:
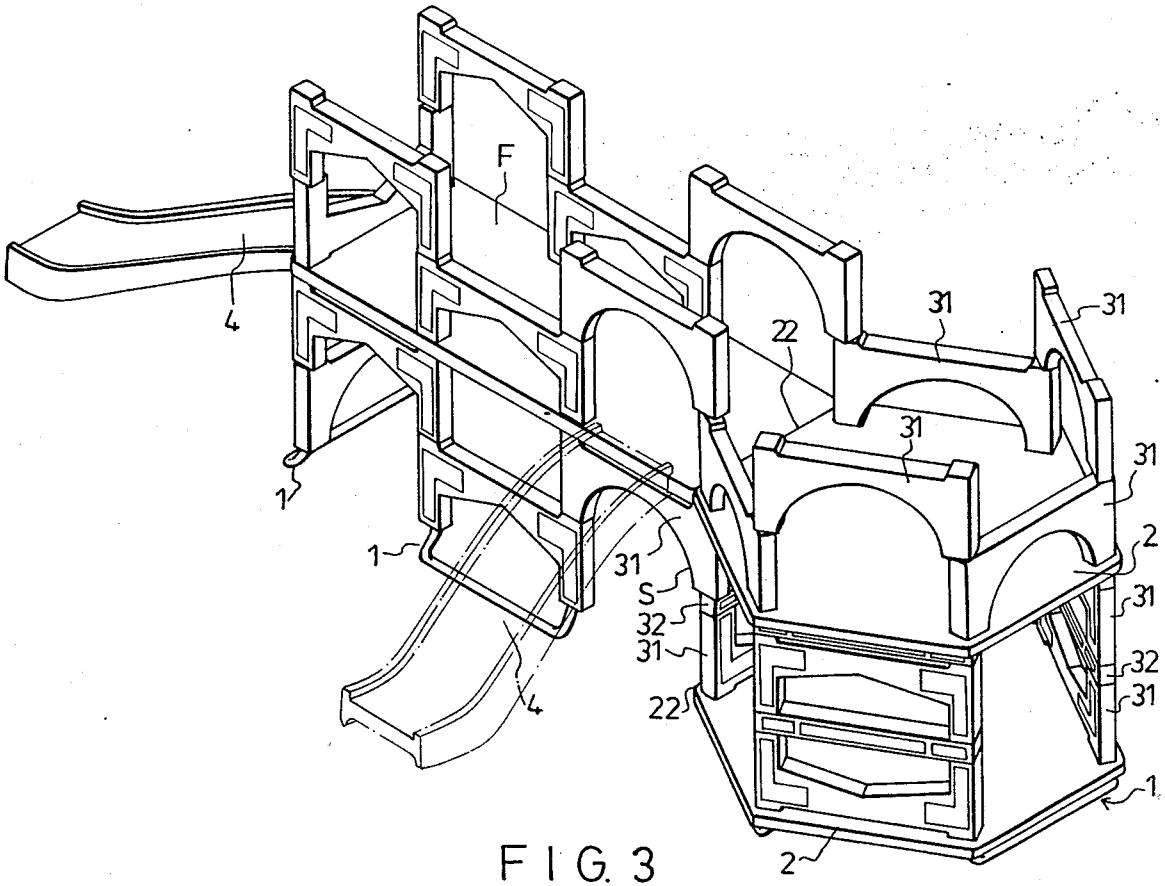
FIG. 3 is a perspective view of a third preferred embodiment of a fabricated amusement platform of this invention.

Referring to FIG. 3, a perspective view of another preferred embodiment of a fabricated amusement platform of this invention is shown. Three skeleton members 1 pass through two hexagonal plates 2 are passed through by in a manner similar to that shown in FIG. 2. A plurality of first and second block members 31, 32 are stacked between the plates 2 in a manner similar to that in FIG. 2 except for the fact that the second block members 32 are passed through by the skeleton members 1 in the same manner as the first block members 31 so that both the first and second block members can be stacked up in the same direction. One edge of the upper plate 22 is connected with a rectangular plate (F) as an extension portion of the upper plate 2. The plate (F) is supported by a plurality of first block members 31 which are respectively passed through by three skeleton members 1 and are stacked in an interlaced relationship, as illustrated in FIG. 3. Two of the first block members 31 are respectively engaged between two of the second block members 31 which are located between the edges 22 of the plates 2 with the leg portions (S) of each of said two first block members being passed through by the columns of the skeleton members (not shown). A plurality of first block members are passed through the protruding portions of the columns of the skeleton members 1 positioned above the upper plate 2 and the rectangular plate (F), in an interlaced relationship along the outer edges of the upper plate 2 and the rectangular plate (F). Each of the uppermost first block members 31 is provided with two holes in a manner similar to that in the first embodiment so that the columns of the skeleton members 1 will not protrude out from the uppermost first block members 31. One or more slides 4 may be connected to the edge(s) of the plate (F) for added amusement purposes, as best illustrated in FIG. 3.

It can be appreciated that the fabricated amusement platform of this invention has the following advantages:

(1) The fabricated amusement platform is assembled without any screw means so that the children playing thereon will not be injured by contacting therewith. In addition, the ends of the skeleton members do not protrude from the fabricated amusement platform, further assuring that children playing thereon will not have the least chance of being accidentally injured.

(2) The fabricated amusement platform can be easily assembled and disassembled so that it can be reassembled at a different location.

(3) The fabricated amusement platform can be reassembled in a variety of patterns according to the playing requirements of the user, increasing the attractiveness thereof.

With this invention thus explained, it is apparent that numerous modifications and variations can be made without departing from the scope and spirit of this invention. It is therefore intended that this invention be limited only as indicated in the appended claims.

I claim:

1. A fabricated platform comprising:

a plurality of skeleton members having at least one pair of columns adapted to be disposed vertically on a mounting surface;

a plurality of block members each having a pair of throughholes adapted to be simultaneously passed through by a pair of columns of one of said skeleton members; and at least one first plate member having a plurality of pairs of holes formed therethrough, the two holes in each pair being spaced apart from each other at a distance which equals the distance between said two columns of one of said skeleton members; whereby said platform is fabricated by passing said columns of said skeleton members through said throughholes of said block members and said holes of said first plate member in order to vertically stack said block members and stably support said first plate member which is suspended among said columns of said skeleton members.

2. A fabricated platform as claimed in claim 1, further comprising a second plate member disposed under said first plate member, said second plate member having a structure which is the same as that of said first plate member and is similarly suspended among said columns of said skeleton members.

3. A fabricated platform as claimed in claim 1, wherein said first plate member is a hexagonal flat plate, with one of said holes formed at each angle thereof.

* * * * *